United States Patent [19]

Favrin

[11] Patent Number: 4,768,367

[45] Date of Patent: Sep. 6, 1988

[54] BENDING BRAKE

[76] Inventor: Pierre Favrin, 72 rue Boileau, Lyon 6 (Rhone), France

[21] Appl. No.: 39,607

[22] Filed: Apr. 16, 1987

[30] Foreign Application Priority Data

Apr. 16, 1986 [FR] France ..... 86 05981

[51] Int. Cl.[4] ..... B21D 5/04

[52] U.S. Cl. ..... 72/319

[58] Field of Search ..... 72/319–323, 72/293, 387, 388

[56] References Cited

U.S. PATENT DOCUMENTS

| | | | |
|---|---|---|---|
| 1,194,602 | 8/1916 | Curtis | 72/321 |
| 4,510,785 | 4/1985 | Triouleyre et al. | 72/319 |

FOREIGN PATENT DOCUMENTS

| | | | |
|---|---|---|---|
| 469946 | 12/1950 | Canada | 72/323 |
| 1040494 | 10/1953 | France | 72/320 |
| 1454083 | 9/1966 | France | 72/319 |

*Primary Examiner*—Daniel C. Crane

*Attorney, Agent, or Firm*—Herbert Dubno

[57] ABSTRACT

A bending brake has a stationary table having a generally planar work surface having a straight front edge, a pivotable table having a generally planar work surface having a straight rear edge, a clamp for retaining a workpiece on the table with an end portion of the workpiece projecting forward past the front edge of the stationary table, and a pivot carrying the pivotable table for angular displacement about a pivot axis substantially parallel to the front edge of the stationary table and generally coinciding with the rear edge of the pivotable table. Supports and guides allow the pivot axis to be displaced such that the axis always lies parallel to the front edge and substantially in the plane of the work surface of the stationary table and in a rearmost position of the pivotable table its rear edge lies against the front edge of the stationary table. The pivotable table is moved about the axis while in contact with the end portion of the workpiece through a bend angle a, the workpiece has a certain thickness e, and the bend has a predetermined internal curvature radius Ri. The pivot axis and rear edge are at a spacing X from the front edge of the stationary table calculated by the formula:

$$X=(Ri+e)\cdot\tan a/2.$$

6 Claims, 2 Drawing Sheets

BENDING BRAKE

FIELD OF THE INVENTION

The present invention relates to a bending brake, that is a press-type machine for bending a sheet or plate normally of metal. More particularly this invention concerns such a device having a pivotable bending element or table that works in conjunction with a stationary element or table.

BACKGROUND OF THE INVENTION

Typically such a bending brake has a clamp device that holds the plate or sheet workpiece down on the stationary table with its end projecting forward past the front edge of the table, over the pivotable table which starts in a position underneath the plane of the stationary table. Two arms carry and flank the pivotable table and have inner ends supported on gudgeons or pivots that define for this table a pivot axis that can be adjusted vertically and horizontally according to workpiece size.

Normally the clamp device has a rounded front edge of a predetermined radius of curvature, which eventually becomes the inside radius of curvature of the bend formed in the workpiece. Thus for a given workpiece thickness and bend radius it is necessary to set the height of this pivot axis, that is its spacing above the surface of the stationary table, and then to set the horizontal spacing between this axis and the rear edge of the pivotable table. To this end the gudgeons are carried in vertically displaceable supports and the pivotable table can be shifted radially of its axis along the arms that carry it. The procedure for setting the brake therefore is a cumbersome two-part operation.

In addition it is necessary to provide a suppcrt arrangement permitting the pivot axis to be moved vertically and to mount the pivotable table slidably on its arms. This structure makes the equipment quite expensive, especially as the forces exerted against the pivot are considerable.

Another problem is that in general in such a press it is necessary to design everything so that it is very robust, that is capable of exceeding its nominal rating by a substantial margin without damage to its parts. If this is not done it is possible to destroy, for instance, the bearings carrying the pivotable table and the elements that move the supports for the pivot gudgeons, relatively easily, for instance, by loading an overthick workpiece into the brake. This requires the use of heavy-duty and expensive actuators, drive spindles, and the like, all greatly augmenting the cost of the machine.

It has been suggested to simplify this arrangement somewhat by making the pivot axis stationary and moving the other table that is stationary during the bending operation vertically and horizontally in accordance with workpiece thickness and bending radius. Such an arrangement has certain advantages, but still requires that the adjustment of the equipment entail two independent steps, the vertical and the separate horizontal positioning, the only change being that the pivot axis can remain stationary with the normally stationary table being vertically adjusted.

OBJECTS OF THE INVENTION

It is therefore an object of the present invention to provide an improved bending brake, that is a press-type apparatus for bending a plate or sheet workpiece.

Another object is the provision of such a bending brake and method of operating same which has the advantage of a single-step adjustment for workpiece thickness and bending radius while being of relatively simple construction.

SUMMARY OF THE INVENTION

A bending brake according to the invention has a stationary table having a generally planar work surface having a straight front edge, a pivotable table having a generally planar work surface having a straight rear edge, a clamp for retaining a workpiece on the table with an end portion of the workpiece projecting forward past the front edge of the stationary table, and a pivot carrying the pivotable table for angular displacement about a pivot axis substantially parallel to the front edge of the stationary table and generally coinciding with the rear edge of the pivotable table. Supports and guides allow the pivot axis to be displaced such that the axis always lies parallel to the front edge and substantially in the plane of the work surface of the stationary table and in a rearmost position of the pivotable table its rear edge lies against the front edge of the stationary table. The pivotable table is moved about the axis while in contact with the end portion of the workpiece through a bend angle a, the workpiece has a certain thickness e, and the bend has a predetermined internal curvature radius Ri. The pivot axis and rear edge are at a spacing X from the front edge of the stationary table calculated by the formula:

$$X=(Ri+e)\cdot\tan a/2.$$

With this system therefore there is only one setting for the pivotable blade, greatly facilitating setup of the machine. This horizontal setting, unlike in the prior-art machines, takes into account a variable—the tangent of half the bend angle—as well as the workpiece thickness, but is still relatively easy to determine. In a standard computer-controlled system, however, the calculation of this trigonometric function and including it in the formula used for setting the movable table is a very simple operation. Thus a computer-controlled bending brake can operate very rapidly, in particular when changing from one thickness of workpiece or bending angle to another.

According to a feature of this invention the apparatus has a stationary frame carrying the stationary table. The setting device includes at least one screw extending parallel to the plane of the stationary-table work surface, at least one nut fixed to the frame, and means for rotating the screw. To protect the machine a fragile element is braced between the nut and the frame and rupturable when the force applied via the screw to the nut exceeds a predetermined limit. This element is a ring having an outer periphery braced against the frame and an inner periphery braced against the nut Between its peripheries the ring is formed on at least one of its faces with an annular grcove. The breaking point of this element is set to be slightly less than the load that would damage the machine. Thus it in effect acts like a fuse one that breaks at a preset mechanical load. As a result it is possible to have the system tuilt to a rating only slightly in excess of its nominal rating. If there is an accidental overload, the only damage will te to the replaceable and cheap ring.

Normally according to this invention the pivot includes a pair of gudgeons supported on respective supports slidable in the frame and braced via respective screws and nuts thereagainst. Respective arms journaled on the gudgeons support the pivotable table.

The method according to this invention therefore comprises the steps of retaining a workpiece on the table with an end portion of the workpiece projecting forward past the front edge of the stationary table, positioning the rear edge of the pivotable table such that it lies on the pivot axis, retaining the pivot axis in the plane of the work surface of the stationary table, and pivoting the pivotable table about the axis while in contact with the end portion of the workpiece through a bend angle. As described above the pivot axis and rear edge are positioned at a spacing from the front edge of the stationary table equal to the tangent of half of the bend angle multiplied by the sum of the radius and the thickness. When operating in accordance with this method it is therefore possible to set the pivotable table for any normal workpiece width or bending angle with a single setting, moving the pivot axis in a single direction.

DESCRIPTION OF THE DRAWING

The above and other features and advantages will become more readily apparent from the following, reference being made to the accompanying drawing in which.

SPECIFIC DESCRIPTION

Figure 1:
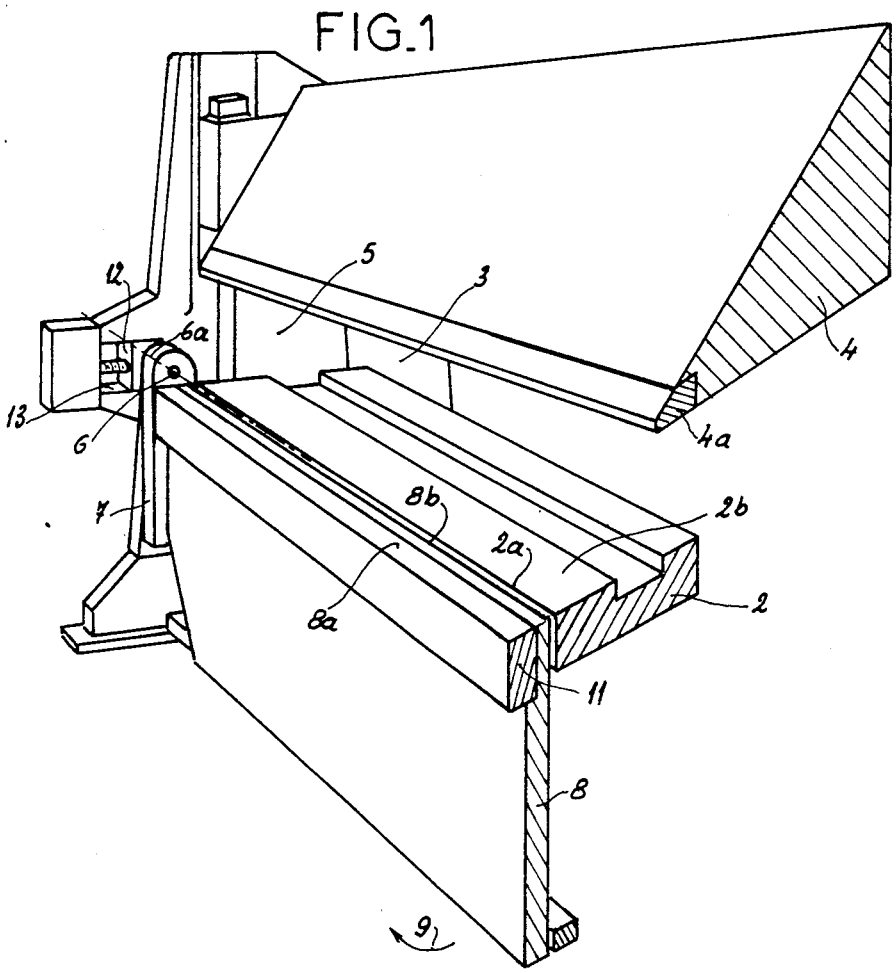
FIG. 1 is a longitudinally sectional and perspective view of the bending brake or press according to the invention.

As seen in FIG. 1 the bending brake according to this invention has, as is standard, a stationary table 2 having a front edge 2*a* and a planar upper surface 2*b*. Above it is a clamp element 4 having a replaceable front bending edge 4*a*. This table 2 is fixed on a frame 5, one end of which is visible in the drawing, which itself forms a guide 13 for a journal block or support 12 carrying a gudgeon 6 itself defining a horizontal pivot axis 6*a* parallel to the edge 2*a*. Arms 7 pivoted on these gudgeons 6 carry a pivotable table 8 having a planar working surface 8*a* that is in the illustrated starting position coplanar with the surface 2*b*, and that has a rear edge 8*b* parallel to the edge 2*a*. Normally the edge 8*a* is mainly formed by a replaceable bar 11, so that it can be replaced if worn just like the clamp strip 4*a*.

According to the invention the axis 6*a* extends exactly along the edge 8*b* and the supports 12 are displaceable only in a straight line parallel to the plane of the surface 2*b*. Thus the guides 13 are simple horizontal tracks receiving the support blocks 12. The table 8 can as a result be pushed back until its edge 8*b* lies directly against the edge 2*a*, that is with the axis 6*a* coinciding with both of the edges 2*a* and 8*b*.

A workpiece such as shown at 14 in FIGS. 2 through 5 is bent in this device by clamping it down against the surface 2*b* by means of the element 4 with an end portion of this workpiece 14 projecting forward (to the left in the drawing) beyond the edge 2*a* and with the pivotable table 8 in the lowered position shown in the drawing. Then this element 8 is pivoted up as shown by arrow 9 so as to bend the workpiece 14 through an angle a and give it a bend having a radius Ri.

Figure 5:
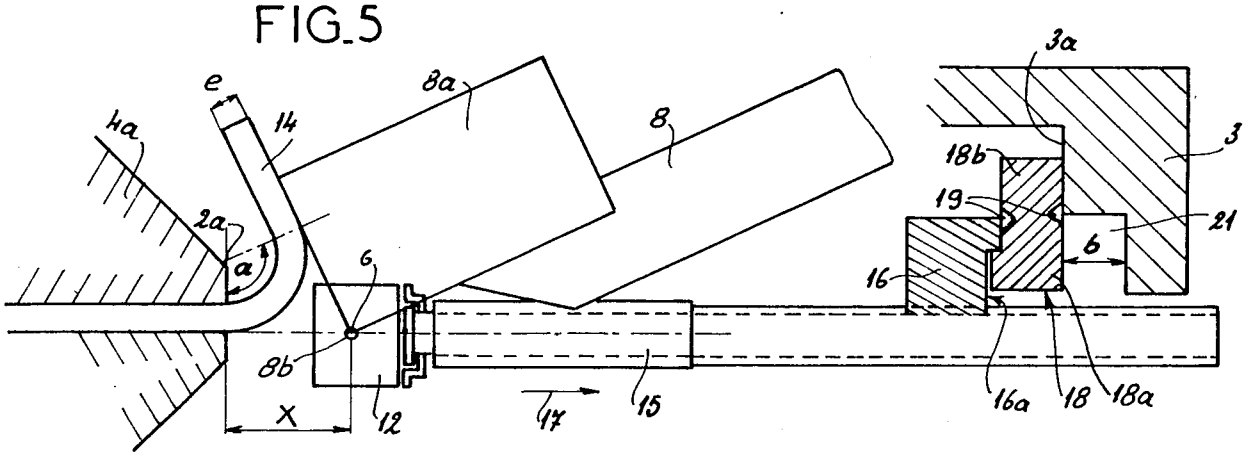
FIG. 5 is a mainly schematic and longitudinally sectional view of a detail of the apparatus of this invention.

As shown in FIG. 5 each support 12 is linked longitudinally but not rotationally to a screw 15 received in a nut shown partially at 16. This nut 16 in turn bears via a washer 18 on a surface 3*a* of the frame 3. The nut 16 only bears on an inner peripheral portion 18*a* of the washer 18 and the surface 3*a* on an outer peripheral portion 18*b*, and both faces of the washer 18 are formed between these portions 18*a* and 18*b* with grooves 19 that weaken it. The frame 3 is undercut at 21 to be spaced by a distance b from the inner peripheral portion 18*a*.

The strength of the washer 18 is such that if the force bearing longitudinally, that is along the axis of the screw 15, on the nut 16 exceeds a certain limit which is set slightly above the nominal rating for the spindles 15 and nuts 16, this washer 18 will fracture at the grooves 19 and will therefore allow the support 12 to move back through the distance b. The strength of these sacrificial washers 18 is such that it makes it impossible to overload the more costly spindles 15 and nuts 16. As a result it is not necessary to greatly overdimension these elements as they are otherwise protected against overload, for instance when an excessively strong workpiece is loaded into the machine.

In accordance with the instant invention, the apparatus is set in its starting position with the two surfaces 2*b* and 8*a* coplanar at a spacing X between the two coplanar edges 2*a* and 8*b* which is determined by three factors: the bend angle a, the inside curvature radius Ri of the desired bend, and the workpiece thickness e. The spacing X is calculated according to the formula:

$$X=(Ri+e)\cdot\tan a/2.$$

Figure 2:
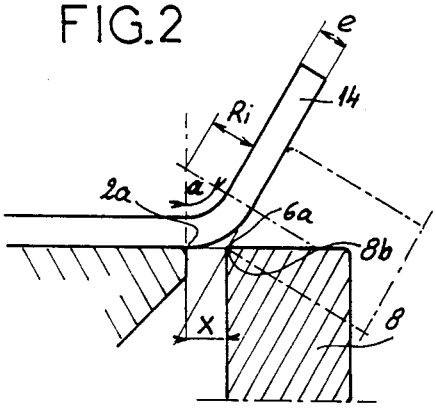
FIGS. 2, 3, and 4 show different bending operations according to this invention.
Figure 3:
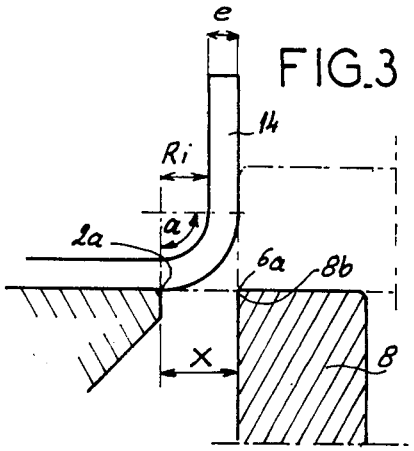
Figure 4:
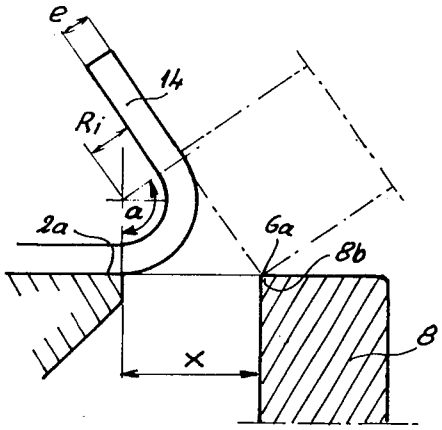

FIGS. 2, 3, and 4 illustrate these relationships, for a workpiece 14 of the same thickness e being bent to the same inside radius Ri, but with the angle a being equal respectively to 120°, 90°, and 60°. Clearly there is an inverse relationship between the distance X and the bend angle a, that is as the one gets bigger the other gets smaller. As mentioned above if the drive motors or the like that synchronously rotate the spindles 15 are computer controlled, it is a very simple matter to have it take care of the necessary calculation, that is all the operator need punch in is the workpiece thickness 3, bending radius Ri, and bend angle a. The computer controller can automatically determine the correct spacing X and set the axis 6*a* accordingly.

I claim:

1. A bending brake comprising:

a stationary table having a generally planar work surface having a straight front edge;

a pivotable table having a generally planar work surface having a straight rear edge;

clamp means for retaining a workpiece on the table with an end portion of the workpiece projecting forward past the front edge of the stationary table;

a pivot carrying the pivotable table for angular displacement about a pivot axis substantially parallel to the front edge of the stationary table and generally coinciding with the rear edge of the pivotable table;

setting means including supports carrying the pivot for displacing same and skid guides for displacement of the supports, said supports and skid guides effecting movement of said pivotable table such that the axis always lies parallel to the front edge and substantially in the plane of the work surface of the stationary table throughout said movement and in a rearmost position of the pivotable table its rear edge lies proximal to the front edge of the stationary table;

actuating means for pivoting the pivotable table about the axis while in contact with the end portion of the workpiece through a bend angle a, the workpiece having a certain thickness e and the bend having a predetermined internal curvature radius Ri, the pivot axis and rear edge being at a spacing X from the front edge of the stationary table calculated by the formula:

$$X=(Ri+e)\cdot\tan a/2.$$

2. The bending brake defined in claim 1, further comprising:

a stationary frame carrying the stationary table, the setting means including at least one screw extending parallel to the plane of the stationary-table work surface, at least one nut fixed to the frame, and means for rotating the screw.

3. The bending brake defined in claim 2, further comprising a fragile element braced between the nut and the frame and rupturable when the force applied via the screw to the nut exceeds a predetermined limit.

4. The bending brake defined in claim 3 wherein the fragile element is a ring having an outer periphery braced against the frame and an inner periphery braced against the nut, the ring being formed between its peripheries with an annular groove.

5. The bending brake defined in claim 2 wherein the pivot includes a pair of gudgeons supported on respective supports slidable in the frame and braced via respective screws and nuts thereagainst.

6. A method of operating a bending brake to bend a workpiece of a certain thickness through a bend angle with a predetermined radius of curvature, said brake comprising:

a stationary table having a generally planar work surface having a straight front edge;

a pivotable table having a generally planar work surface having a straight rear edge;

a pivot carrying the pivotable table for angular displacement about a pivot axis substantially parallel to the edges of both tables; and means including supports carrying the pivot for displacing same and the axis substantially perpendicular to the axis; the method comprising the steps of:

retaining a workpiece on the table with an end portion of the workpiece projecting forward past the front edge of the stationary table;

positioning the rear edge of the pivotable table such that it lies on the pivot axis;

positioning the pivot axis and rear edge at a spacing from the front edge of the stationary table equal to the tangent of half of the bend angle multiplied by the sum of the radius and the thickness;

retaining the pivot axis in the plane of the work surface of the stationary table; and pivoting the pivotable table about the axis while in contact with the end portion of the workpiece through a bend angle.

* * * * *